US008564162B2

(12) United States Patent
Charleux et al.

(10) Patent No.: US 8,564,162 B2
(45) Date of Patent: Oct. 22, 2013

(54) ACTUATOR FOR OPERATING A SLIDING CURTAIN

(75) Inventors: Olivier Charleux, Thyez (FR); Scot Cochran, San Diego, CA (US); Jean-Michel Perache, Taninges (FR); Rich Scharf, Escondido, CA (US)

(73) Assignee: Somfy SAS, Cluses (FR)

( * ) Notice: Subject to any disclaimer, the term of this patent is extended or adjusted under 35 U.S.C. 154(b) by 734 days.

(21) Appl. No.: 12/618,658

(22) Filed: Nov. 13, 2009

(65) Prior Publication Data

US 2010/0122781 A1 May 20, 2010

(30) Foreign Application Priority Data

Nov. 17, 2008 (FR) ..... 08 57800

(51) Int. Cl.
*H02K 5/00* (2006.01)
*A47H 1/00* (2006.01)

(52) U.S. Cl.
USPC ..... 310/89; 160/331; 160/84.2; 160/310

(58) Field of Classification Search
USPC ..... 160/331, 84.02, 310; 310/89
See application file for complete search history.

(56) References Cited

U.S. PATENT DOCUMENTS 5,500,972 A * 3/1996 Foster ..... 15/28
5,889,377 A 3/1999 Mao
6,150,744 A * 11/2000 Onishi ..... 310/89
7,337,825 B1 3/2008 Erbe
2003/0121622 A1* 7/2003 Killo et al. ..... 160/331
2006/0202571 A1* 9/2006 Wilkinson et al. ..... 310/50

FOREIGN PATENT DOCUMENTS

EP 1316281 A1 6/2003
GB 1011823 A 12/1965

OTHER PUBLICATIONS

INPI Search Report for French Application No. 08 57800, dated Jul. 1, 2009.

* cited by examiner

*Primary Examiner* — Tran Nguyen
*Assistant Examiner* — Leda Pham
(74) *Attorney, Agent, or Firm* — Procopio, Cory, Hargreaves & Savitch LLP; Noel C. Gillespie

(57) ABSTRACT

This electro-mechanical actuator is used to operate a curtain mounted to slide along an axis. It comprises a motor (24), a power supply unit (22) for powering the motor and a box (20), the motor (24) and the power supply unit (22) being received in a first housing (L1) that is internal to the box (20). The box (20) forms at least one second internal housing ($L_2$, $L'_2$), separated from the first internal housing by a wall (35, 43) of the box, and in which an electrical or electronic component (28, 50) of the actuator is received that is distinct from the motor (24) and from the power supply unit (22). A removable cover (33, 41) isolates the or each second housing ($L_2$, $L'_2$) from the outside of the box (20).

18 Claims, 5 Drawing Sheets

ACTUATOR FOR OPERATING A SLIDING CURTAIN

RELATED APPLICATIONS INFORMATION

This application claims the priority to French Patent Application No. 08 57800, filed Nov. 17, 2008, and entitled "An Actuator for Operating a Sliding Curtain," which is incorporated herein by reference as part of the specification of this application.

BACKGROUND

1. Technical Field

The invention relates to the field of motor-driven sun protection installations, and in particular to the field of sliding curtains. Such a curtain is generally fastened to a set of a plurality of slides mounted to move along a rail. A first slide is fastened to a carriage driven in the rail via a belt or a cord under the action of an actuator. The movement of the first slide entrains the movement of the following slides, either via the curtain itself, or via cords that connect each slide to the following slide.

2. Related Art

Motor-driven curtains are in common use in hotel rooms or in conference centers, i.e. where users are merely passing through and are unused to how such curtains operate. Such installations must be discreet, as out of sight as possible, and not too noisy, while also being protected in the event that the curtain is operated manually by an uninformed user.

The actuator described in Document U.S. Pat. No. 6,076,592 has a longitudinal box that is perpendicular to the rail supporting the curtain that is to be operated. When an outlet shaft of the actuator is moved in rotation, it drives a belt of the curtain installation in rotation via a clutch. The clutch makes manual control possible when the motor is off and when the curtain is decoupled from the motor.

When the actuator is mounted perpendicularly to the rail, it is usually placed below the rail, so as to be masked, at least partially, by a side edge of the curtain. The motor, the gearbox and the clutch are situated towards the top end of the box, while the power supply and control device for powering and controlling the motor is situated towards the bottom end. The motor is powered via the control device which transmits power to the motor, possibly after transformation, e.g. 24 volt DC low-voltage power, together with a command.

For most installations, a power cable must therefore be connected to the box of the actuator on the same side as the power supply and control device. In the example in Document U.S. Pat. No. 6,076,592, a power first cable arrives towards the bottom of the box, and a control second cable exits from the box on a side face thereof and rises towards a detection element placed at the end of the rail. The connection of the power cable to the box is sometimes grouped together with an adjustment interface that is situated either at the bottom of the box, or on a side face. In any event, the cable can easily be disconnected inadvertently by an uninformed user, insofar as access to the cable, like access to the adjustment interface, is left free. In addition, the manner in which the motor is disposed relative to the control device often constrains the power cable to run along the box, since the mains power terminal is generally situated in a false ceiling.

In addition, WO2004/011759 discloses providing a guide groove for guiding a cable in a cradle for mounting a motor-and-gearbox unit in a rail. The cable remains visible and accessible over most of its length, which is acceptable for a motor-and-gearbox unit mounted in a rail, but is inappropriate for a curtain actuator that is mounted like the actuator of U.S. Pat. No. 6,076,592.

SUMMARY

The invention thus proposes to remedy the above-mentioned problems and to provide a box structure that satisfies the technical and esthetic needs sought in the field of motor drives for curtains.

To this end, the invention provides an electro-mechanical actuator for operating a curtain mounted to slide along an axis, said actuator comprising a motor, a power supply unit for powering the motor and a box, the motor and the power supply unit being received in a first internal housing that is internal to the box. Said electro-mechanical actuator is characterized in that the box forms at least one second internal housing, separated from the first internal housing by a wall of the box, and in which an electrical or electronic component of the actuator is received, that is distinct from the motor and from the power supply unit, and in that a removable cover isolates the or each second housing from the outside of the box.

By means of the invention, the second internal housing of the box makes it possible to accommodate a component such as a power supply cable or an electronic control module that is thus protected from impacts and that is not visible, thereby improving the overall esthetic appearance of the actuator. In addition, the use of a cover isolating the second housing prevents any interfaces that it contains from being used inappropriately, and makes it possible to use control modules that are interchangeable.

In advantageous but non-essential aspects of the invention, such an actuator may incorporate one or more of the following characteristics, taken in any technically feasible combination:

- the first internal housing and the second internal housing are formed inside a main body of the box;
- the second internal housing is formed by a longitudinal trough or raceway provided in the main body;
- the second housing is delimited, on the one hand, by a main hollow body of the box which forms the first housing and, on the other hand, by the removable cover.
- the second housing is elongated and receives at least a portion of a power cable extending between a zone of the box that is situated in the vicinity of the power supply unit and a zone that is remote therefrom;
- the wall is provided with a through opening for enabling the power cable to pass between the first housing and the second housing;
- the power cable passes through an anti-traction ring installed at the opening in the wall;
- the cover is mounted via two series of runners on a main body of the box that defines the first internal housing;
- the cover and/or a main body of the box that defines the first internal housing is/are provided with means for holding an element of trim for the box;
- the outside section of the box has an external geometrical shape without any sudden change of slope or of angle;
- the box has a removable base, said base forming a support for the power supply unit and/or for the motor;
- the removable base is provided with a control and configuration panel for controlling and configuring the actuator;
- the second internal housing is formed by the removable base mounted at one end of a main body of the housing that defines the first internal housing, while an electronic control module for controlling the actuator is received in the second housing;

a portion of the base forms the separator wall between the first internal housing and the second internal housing of the box;

one second internal housing extends along the main body and receives a portion of a power cable for powering the elements received in the first housing, and another second internal housing defined by the removable base receives an electronic control module for controlling the actuator; and the cover is provided with a zone of weakness, so that it can be cut out to form a cable passage.

BRIEF DESCRIPTION OF THE DRAWINGS

The invention can be better understood and other advantages of the invention appear more clearly from the following description of an embodiment of an actuator that complies with the principle of the invention, the description being given merely by way of example and with reference to the accompanying drawings, in which.

DETAILED DESCRIPTION

Figure 1:
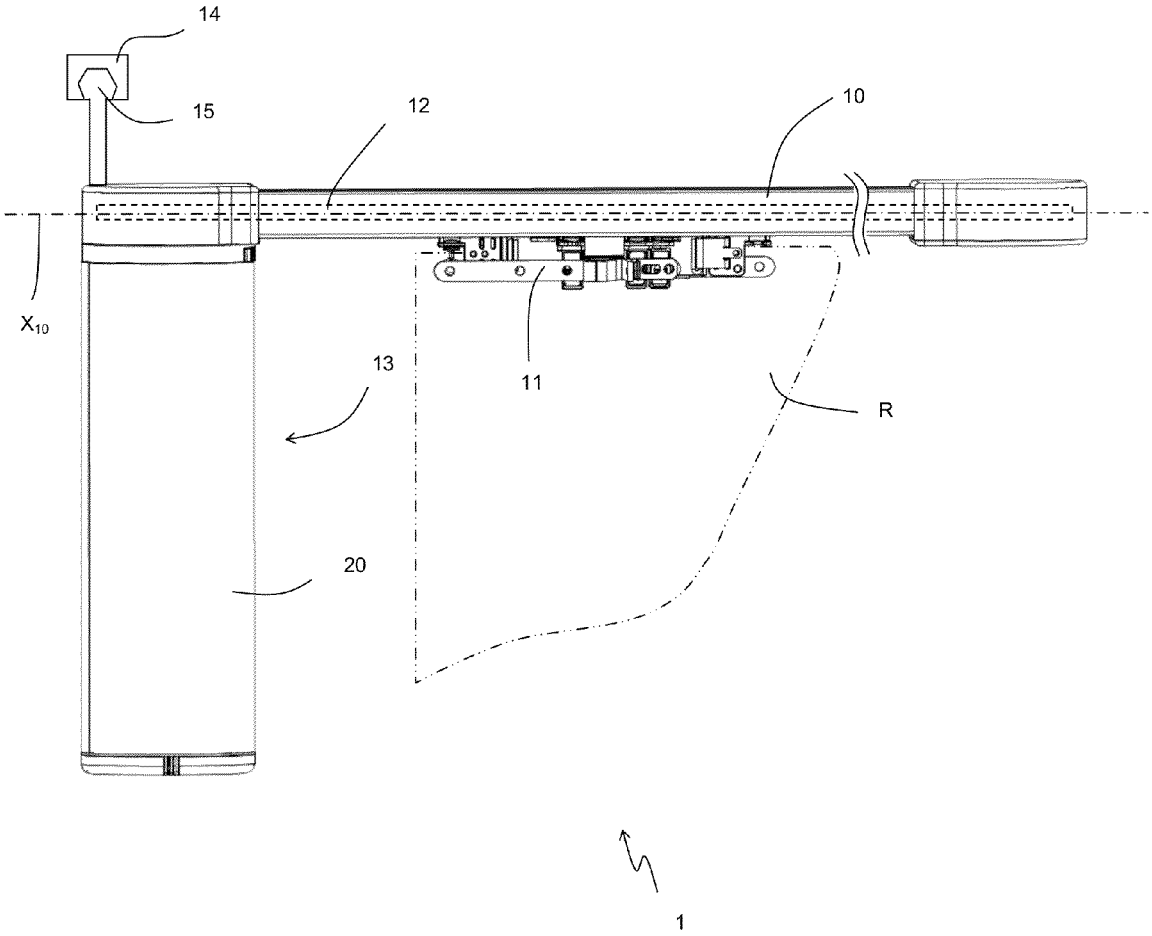
FIG. 1 is a schematic view of a sun protection installation having sliding curtains and incorporating an actuator of the invention.

FIG. 1 is an overall view of a portion of a motor-driven curtain installation 1. A curtain R shown in chain-dotted lines is suspended from a rail 10 by hooks. At least one hook secured to the curtain R is fastened to a carriage 11 that is driven by a belt 12 moving in the rail 10 under the effect of an electro-mechanical actuator 13 that is mounted at one end of the rail. The curtain 11 can thus be moved along the longitudinal axis X10 of the rail 10.

The components of the actuator 13 are contained in a box 20 of elongate shape.

The actuator 13 is powered from a power supply terminal 14 situated above the rail 10, preferably in a false ceiling (not shown).

Figure 2:
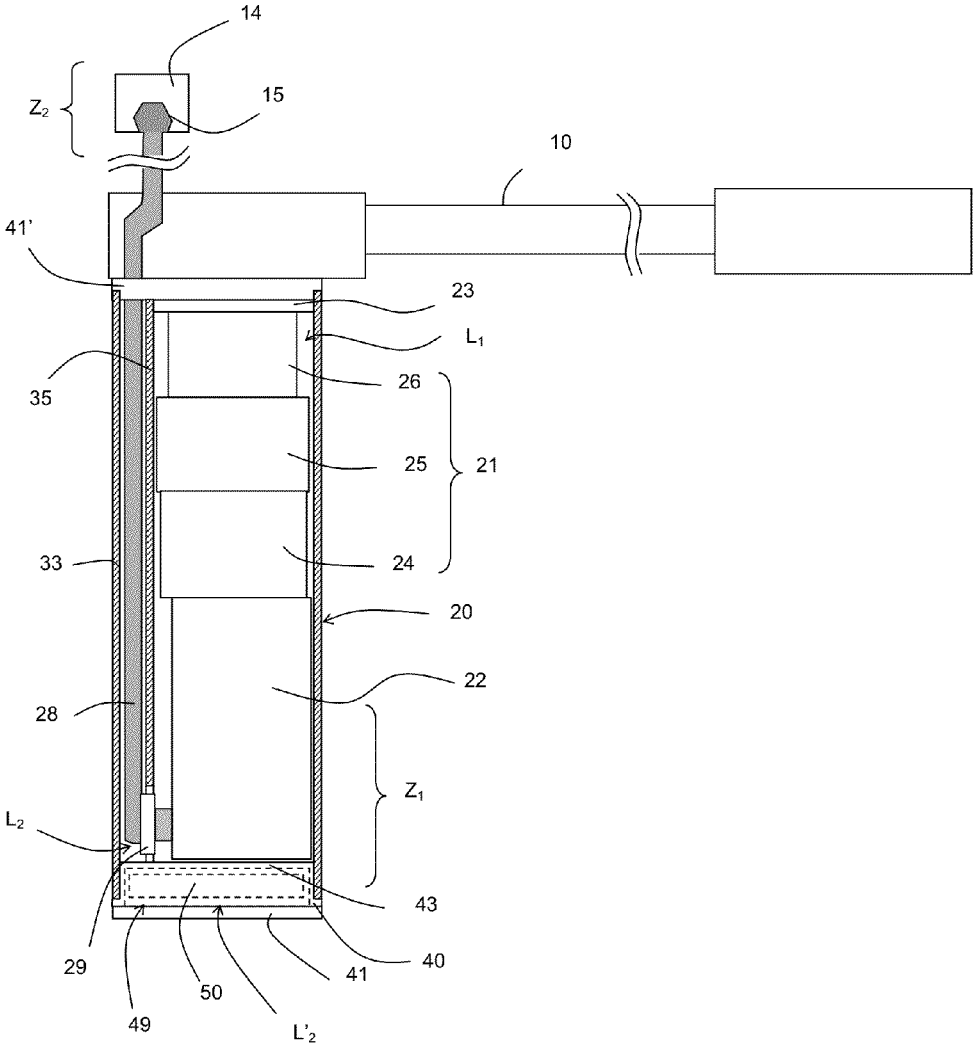
FIG. 2 is a schematic longitudinal section view of the actuator of FIG. 1.

The actuator is shown schematically in FIG. 2. Inside the elongate box 20, the actuator comprises a motor unit 21 and a power supply unit 22. A detection member 23 for detecting the position of the carriage 11 along the rail 10 is situated above the motor unit. The motor unit comprises an electric motor 24, a gearbox 25, and a clutch 26. The gearbox and the clutch can also be combined into a single element. The detection member, e.g. a set of optical sensors, could also be situated inside the motor unit 21, e.g. between the gearbox and the clutch, or between the motor and the gearbox. Alternatively, the detection member could be situated in a housing that is separated from the housing L1 containing the motor unit 21 and the power supply unit 22.

A power cable 28 extends between the power supply unit 22 and the top of the actuator. Said cable 28 is connected to the power supply terminal 14 by means of a connector 15. In particular where it has a bend, the cable 28 preferably passes through an anti-traction ring 29 that prevents traction forces that are too large form being exerted on said cable, in its portion that is connected to the power supply unit 22.

Figure 3:
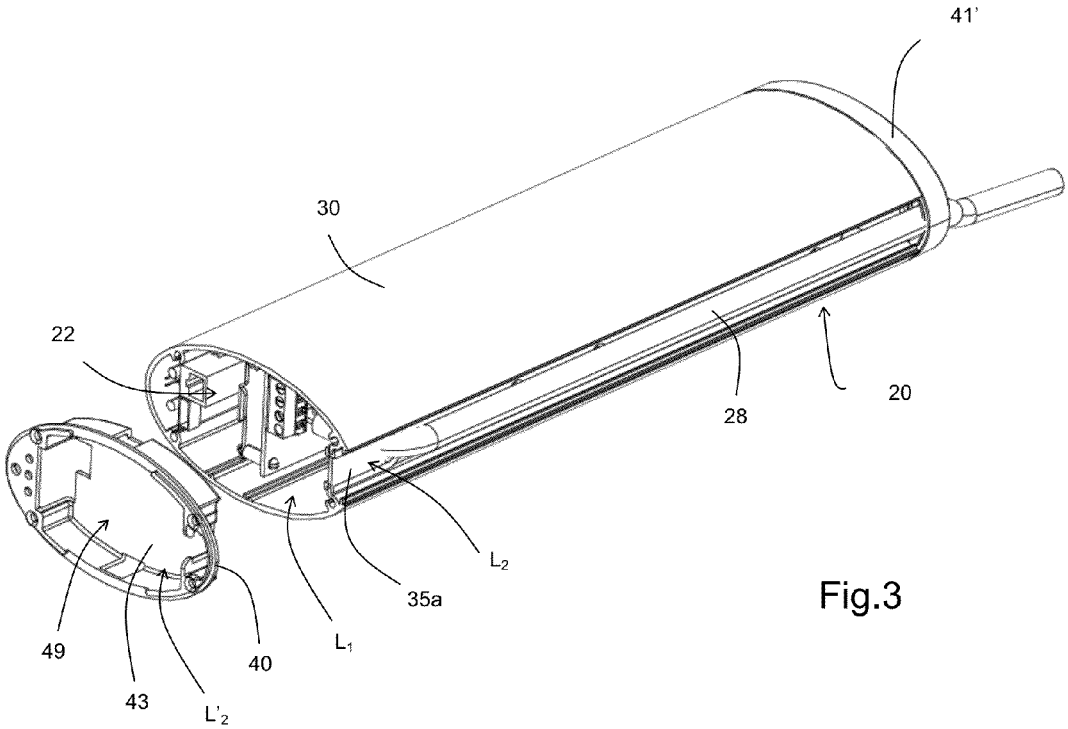
FIG. 3 is a fragmentary exploded perspective view of the actuator of FIG. 2.

FIG. 3 is also a three-dimensional view that shows how the cable runs along the box. In this view, only some of the components of the actuator are shown. In particular, the cover 33 is not shown in order to make the drawing clearer.

Figure 5:
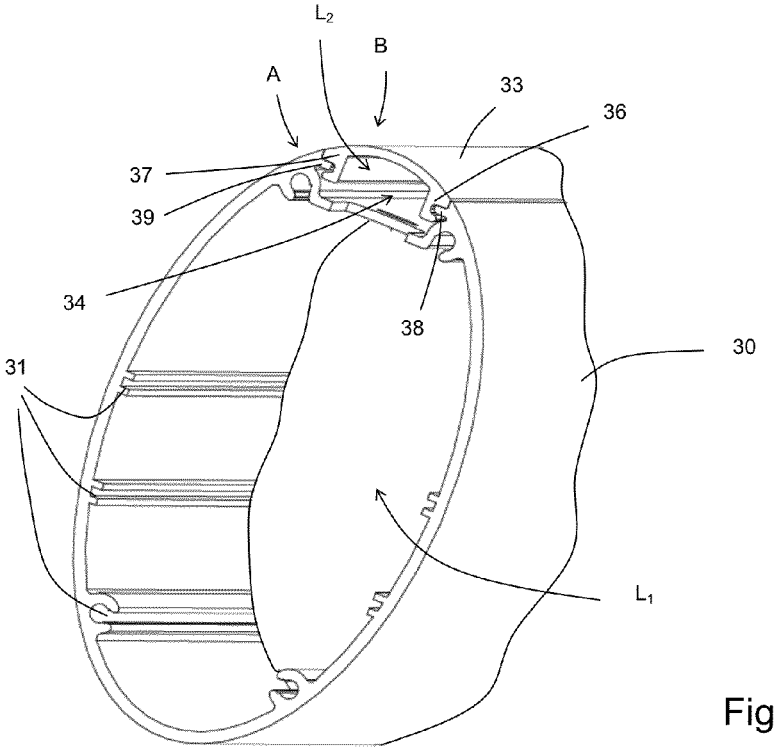
FIG. 5 is a fragmentary perspective view of a main body and of a cover of the box of FIG. 4.
Figure 4:
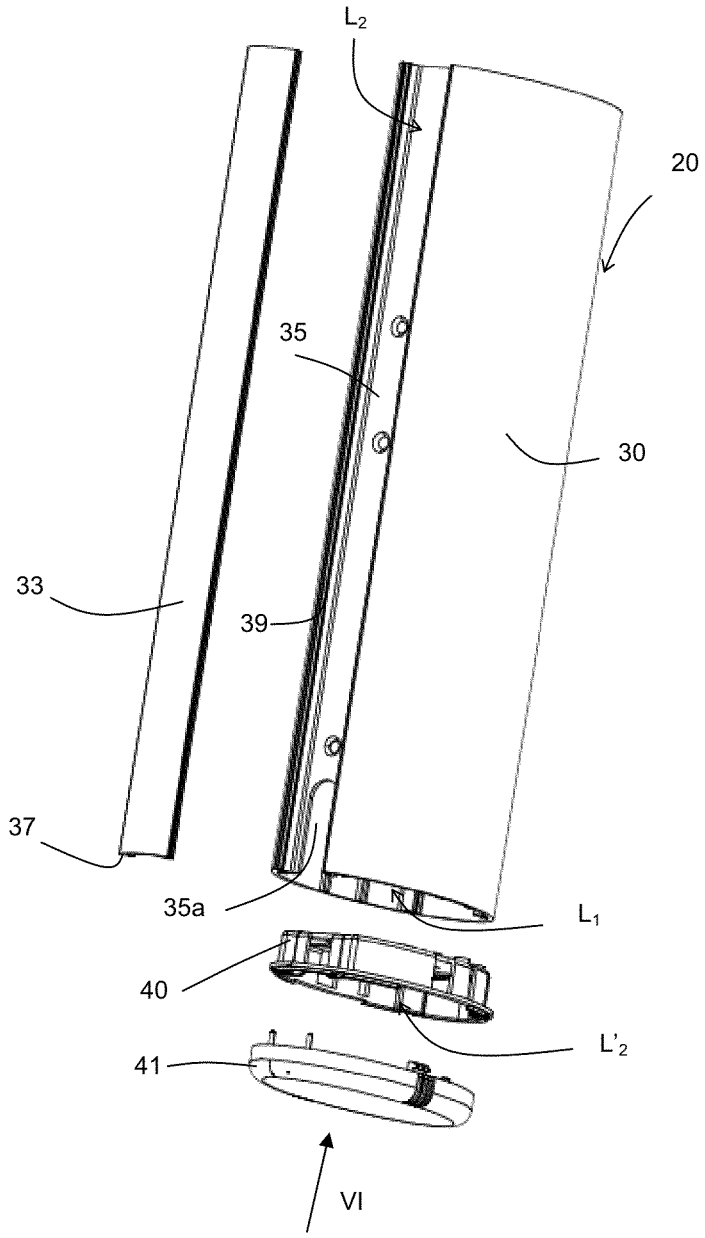
FIG. 4 is a perspective view of the box of the actuator of FIGS. 1 and 2.

The box is also shown in FIGS. 4 and 5. It comprises a hollow main body 30 that is formed integrally and that is cylindrical in overall external shape, with an elliptic base. The main body 30 could also have a circular base. The body 30 defines an internal housing L1 in which the motor unit 21, the unit 22, and the member 23 are received, as are electrical conductors (not shown). A portion of the motor unit 21 and of the power supply unit 22, in particular the corresponding printed circuits, can be held in runners 31 provided on the inside faces of the body 30. When the actuator is in the assembled configuration, the housing L1 is isolated from the outside by the body 30 and by the portions that closes it off at its ends. The materials present in said housing are thus protected from mechanical attack and/or from ambient humidity.

Thus, with the exception of its extremities, housing L2 is delimited only between parts 30 and 33, which is very simple to realize and provides a good sealing.

The hollow body is elliptical in overall section, with one of the small-radius-of-curvature sides A of the elliptical shape being truncated. The complementary portion B making up the elliptical section is formed by means of a cover 33 of section that finishes off the truncated elliptical section. Thus, overall, with both the body 30 and the cover 33, the box 20 has an external geometrical shape without any sudden change of slope or of angle.

In FIG. 2, only the body 30 and the cover 33 are shown in section, the other elements being shown as seen from the outside.

The cover 33 can be said to be "longitudinal" insofar as it extends over the corresponding length of the body 30 of the box 20. The truncation of the body 30 at the side A forms a longitudinal trough or raceway 34 that extends over the entire length of the body 30. The cover 33 masks access to the trough 34 from the outside. A wall 35 that is formed integrally with the body 30 separates the trough 34 from the housing L1. The trough 34 thus forms a second housing L2 that is internal to the box 20, and that extends over the entire length of the body 30, and that the cover 33 isolates from the outside. The cable 28 is received in this housing L2 over the height of the body 30, thereby enabling it to connect a zone Z1 close to the unit 22 and inside the housing L1 to a zone Z2 in which the power supply terminal 13 is positioned, outside the actuator 13.

The wall 35 is provided with a through opening 35*a* for enabling the cable 28 to pass between the housings L1 and L2. The anti-traction ring 29 is held stationary in said opening. As can be seen in FIG. 4, the opening 35*a* can be constituted by a cutout in the wall 35 that opens out at one end of the body 30, which facilitates putting the ring 29 in place. However this is not obligatory, and the opening 35*a* can be provided anywhere in the wall 35.

The cover 33 can be made of the same material as the body 30, but it can also be made of some other material, e.g. made of a plastics material when the body 30 is made of metal.

Advantageously, the cover 33 can be cut up into a plurality of portions, or provided with a through hole over its height so as to enable the cable 28 to exit at any height up the box.

The cover is mounted removably on the body 30.

The cover is provided with two side runners 36 and 37. It can have resilient properties so that it is possible to insert it by exerting a slight deformation force enabling it to come to lock in runners 38 and 39 of corresponding shapes that provided in the body 30. Alternatively, it can be inserted by being slid from one end of the body 30.

Advantageously, and in particular at the means 36 to 39 for fastening it, the cover 33 and/or the body 30 of the box 20 is provided with means for holding an element of trim for the box, which element is not shown. This element of trim can be a fabric that comes to cover the body of the box, which fabric matches or is identical to the curtain of the installation. For example, a fabric can be clamped between the runners 36 & 38 on one side and between the runners 37 & 39 on the other side over the length of the cover 33.

This box configuration enables the power cable 28 at mains voltage (230 V) to be passed through safely, inaccessibly to a user, and separately from the main elements of the actuator 13 that are constituted by the motor unit 21 and by the power supply unit 22. When the mains power supply terminal 14 is situated in a false ceiling, the power cable is guided along the box towards the top of said box.

Conversely, the mains power supply terminal 14 can be situated towards the bottom of the installation. It is then preferable to have the cable exit towards the bottom of the actuator, which is possible because the housing L2 opens out at the bottom of the box 20. In addition the cover 33 can be provided with zones of weakness making it possible to form a through opening for passing the cable 28 by localized cutting-out of the cover 33, e.g. when the power supply terminal 14 is situated half-way up the actuator 13.

The housing L2 formed by the trough 34 and by the cover 33 thereof thus makes it possible to configure the actuator 13 in its form that is most adapted to the installation on site.

At one of the ends of the hollow body 30, the box 20 is also provided with a base 40 supporting at least a portion of the power supply unit 22 and/or of the motor unit 21. This base is recessed in dish-shaped manner, and is closed off at its end opposite from the body 30 by a removable cover or cap 41. The base 40 penetrates at least in part into the hollow body 30 when the box 20 is assembled. The base 40 can be slide out of the body of the box to give simple access to the power supply unit 22.

A removable cover or cap 41' is mounted on the body 30 at the end opposite from the base 40. In order to make the drawings clearer, this cover 41' is shown in FIGS. 2 and 3 only.

Figure 6:
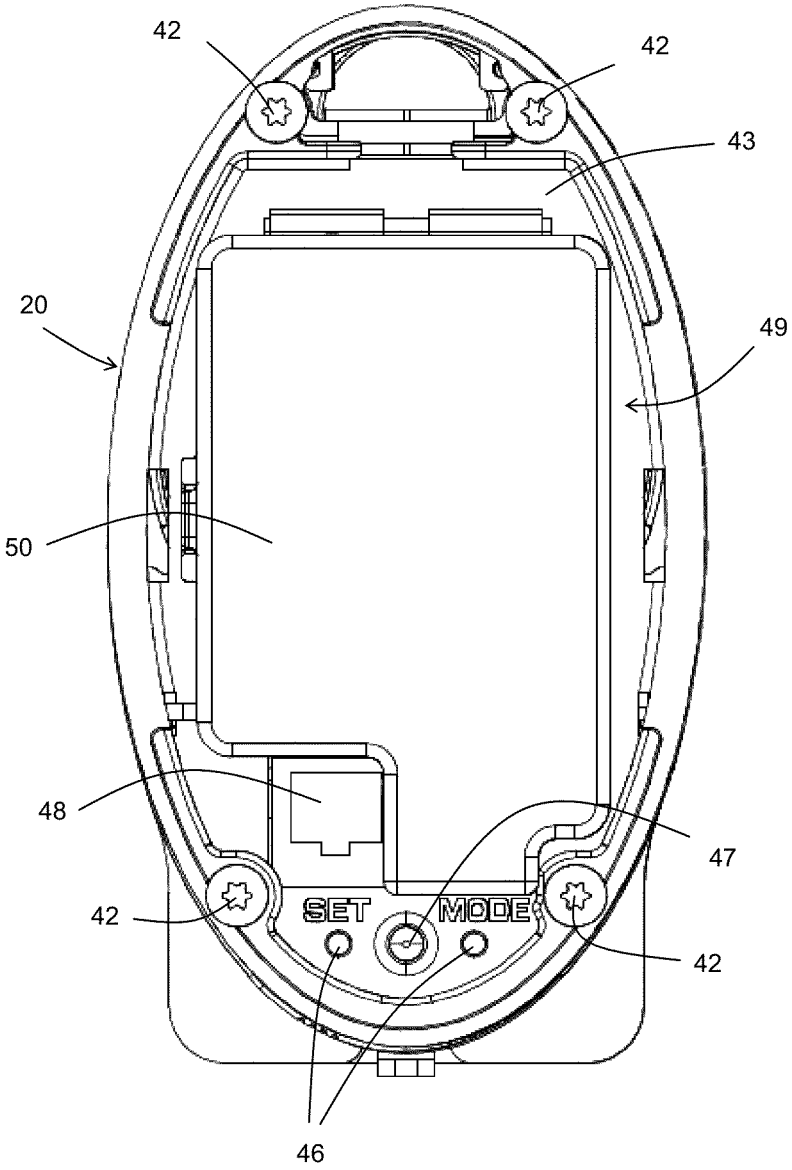
FIG. 6 is a view from below, seen looking along arrow VI in FIG. 4, showing a base that is part of the box of FIG. 4.

FIG. 6 is a view of the actuator from below, when the cover 41 is removed. The base 40 is fastened to the body 30 of the box in removable manner, e.g. by screws 42. The end wall or web of the base 40 is referenced 43, this web being perpendicular to the height of the box 20, i.e. to the runners 31, 38, and 39 in the configuration in which the base 40 is mounted on the body 30. On one of its faces, said web supports at least a portion of the unit 22 and/or of the motor unit 21.

The base 40 supports a control and configuration panel 45 for controlling and configuring the actuator 13, this panel being provided with adjustment buttons 46 (SET and MODE) and with monitoring light-emitting diodes (LEDs) 47. It also supports a connector 48 of the RJ9 type (of the telephone cable connector type), which connector is used for connection to a very low voltage (VLV) control cable towards a dry contact or towards an interface with other control systems (not shown) external to the box 20.

The VLV cable can also run inside the housing L2 of the box when it is more judicious to connect said VLV cable towards the top of the box 20.

The base 40 is partially hollow or "recessed" and it defines a cavity 49 in which an electronic control module 50 is received. Said control module 50 can be adapted for different versions of the actuator 13 and can thus have an infrared receiver, a radio receiver, another connector for dry contact, for making individual and general control possible, or a connector of some other type, e.g. of the RS485 type, for a link to a control bus.

When the cover 41 is in place on the base 40, the cavity 49 forms a second housing L'2 that is inside the box 20 and that is separated from the housing L1 by the end web 43.

Access to the control module 50 is substantially masked by the cover 41 when said cover is in place on the base 40.

The cover 41 and/or the base itself 40 is/are provided with a zone (not shown) of weakness making it possible to form a passage for the power cable 28 or for the VLV control cable when it is necessary or more appropriate to have the cables pass towards the bottom of the actuator 13. Otherwise, the cover 41 seals off the body 30 of the box at its bottom portion.

The cover 41 is mounted removably on the base 40, e.g. it is clip-fastened or screw-fastened, so as to make the control and configuration panel 48 and/or the module 50 accessible whenever necessary. The control module 50 is thus easily interchangeable. The base 40 protects the user in that it separates a relatively high current power supply (mains power supply) zone from a VLV power supply zone.

What is claimed is:

1. An electro-mechanical actuator for operating a curtain mounted to slide along an axis, said actuator comprising a motor configured to drive a belt for opening and shutting the curtain, a power supply unit comprising printed circuits for powering the motor, and a box, the motor and the power supply unit being received in a first internal housing that is internal to the box, wherein the box forms at least one second internal housing, separated from the first internal housing by a wall of the box, and in which an electrical or electronic component of the actuator is received that is distinct from the motor and from the power supply unit, and wherein a removable cover isolates the at least one second internal housing from the outside of the box.

2. An actuator according to claim 1, wherein the first internal housing and the at least one second internal housing are formed inside a main body of the box.

3. An actuator according to claim 2, wherein the at least one second internal housing is formed by a longitudinal trough provided in the main body.

4. An actuator according to claim 1, wherein the at least one second housing is delimited, on the one hand, by a main hollow body of the box which forms said first housing and, on the other hand, by the removable cover.

5. An actuator according to claim 1, wherein the at least one second housing receives at least a portion of a power cable extending between a zone of the box that is situated in the vicinity of the power supply unit and a zone that is remote therefrom.

6. An actuator according to claim 5, wherein the wall is provided with a through opening for enabling the power cable to pass between the first housing and the at least one second housing.

7. An actuator according to claim 6, wherein the power cable passes through an anti-traction ring installed at the opening in the wall.

8. An actuator according to claim 1, wherein the cover is mounted via two series of runners on a main body of the box that defines the first internal housing.

9. An actuator according to claim 1, wherein the cover and/or a main body of the box that defines the first internal housing is/are provided with means for holding an element of trim for the box.

10. An actuator according to claim 1, wherein the outside section of the box has an external geometrical shape without any sudden change of slope or of angle.

11. An actuator according to claim 1, wherein the box has a removable base, said base forming a support for the power supply unit and/or for the motor.

12. An actuator according to claim 11, wherein the removable base is provided with a control and configuration panel for controlling and configuring the actuator.

13. An actuator according to claim 11, wherein the at least one second internal housing is formed by the removable base mounted at one end of a main body of the box that defines the first internal housing, and wherein an electronic control module for controlling the actuator is received in the at least one second internal housing.

14. An actuator according to claim 13, wherein the first internal housing and at least one second internal housing are formed inside a main body of the box and wherein the at least one second internal housing extends along the main body and receives a portion of a power cable for powering the elements received in the first housing, and wherein another second internal housing defined by the removable base receives an electronic control module for controlling the actuator.

15. An actuator according to claim 1, wherein the cover is provided with a zone of weakness, so that it can be cut out to form a cable passage.

16. An actuator according to claim 1, wherein a detection member configured to detect the position of the carriage driven by the belt is situated inside the box, in the first internal housing.

17. An actuator according to claim 1, wherein a detection member configured to detect the position of a carriage driven by the belt is situated inside the box, in a housing separated from the first internal housing.

18. An actuator according to claim 1, wherein said power supply unit is connected to a power supply terminal via a power cable.

* * * * *